United States Patent [19]

Miliaras

[11] Patent Number: 4,686,832

[45] Date of Patent: Aug. 18, 1987

[54] INTEGRATED FUEL CLEANING AND POWER GENERATION

[76] Inventor: Emmanuel S. Miliaras, 12 Mount Pleasant St., Winchester, Mass. 02142

[21] Appl. No.: 859,056

[22] Filed: Apr. 28, 1986

[51] Int. Cl.[4] ..... F01K 21/00

[52] U.S. Cl. ..... 60/676

[58] Field of Search ..... 60/676

[56] References Cited

U.S. PATENT DOCUMENTS

| | | | |
|---|---|---|---|
| 2,867,983 | 1/1959 | Armacost | 60/676 X |
| 3,016,712 | 1/1962 | Taylor | 60/676 |
| 3,362,163 | 1/1968 | Pacault | 60/676 |
| 3,950,949 | 4/1976 | Martin et al. | 60/676 X |
| 4,069,675 | 1/1978 | Adler et al. | 60/676 X |
| 4,085,593 | 4/1978 | Larsen | 60/676 |

FOREIGN PATENT DOCUMENTS

| | | | |
|---|---|---|---|
| 3044991 | 7/1982 | Fed. Rep. of Germany | 60/676 |

*Primary Examiner*—Allen M. Ostrager

*Attorney, Agent, or Firm*—Joseph S. Iandiorio; Douglas E. Denninger

[57] ABSTRACT

Disclosed is a method for the generation of electricity or propulsive power from fossil-fuels which combines fuel cleaning with a thermodynamic cycle utilizing two or more combustors which fire the differing quality streams from the fuel cleaning plant. The method accomplishes emissions reduction at good energy conversion efficiency and a reduced overall plant equipment cost.

15 Claims, 1 Drawing Figure

INTEGRATED FUEL CLEANING AND POWER GENERATION

FIELD OF INVENTION

Figure 1:
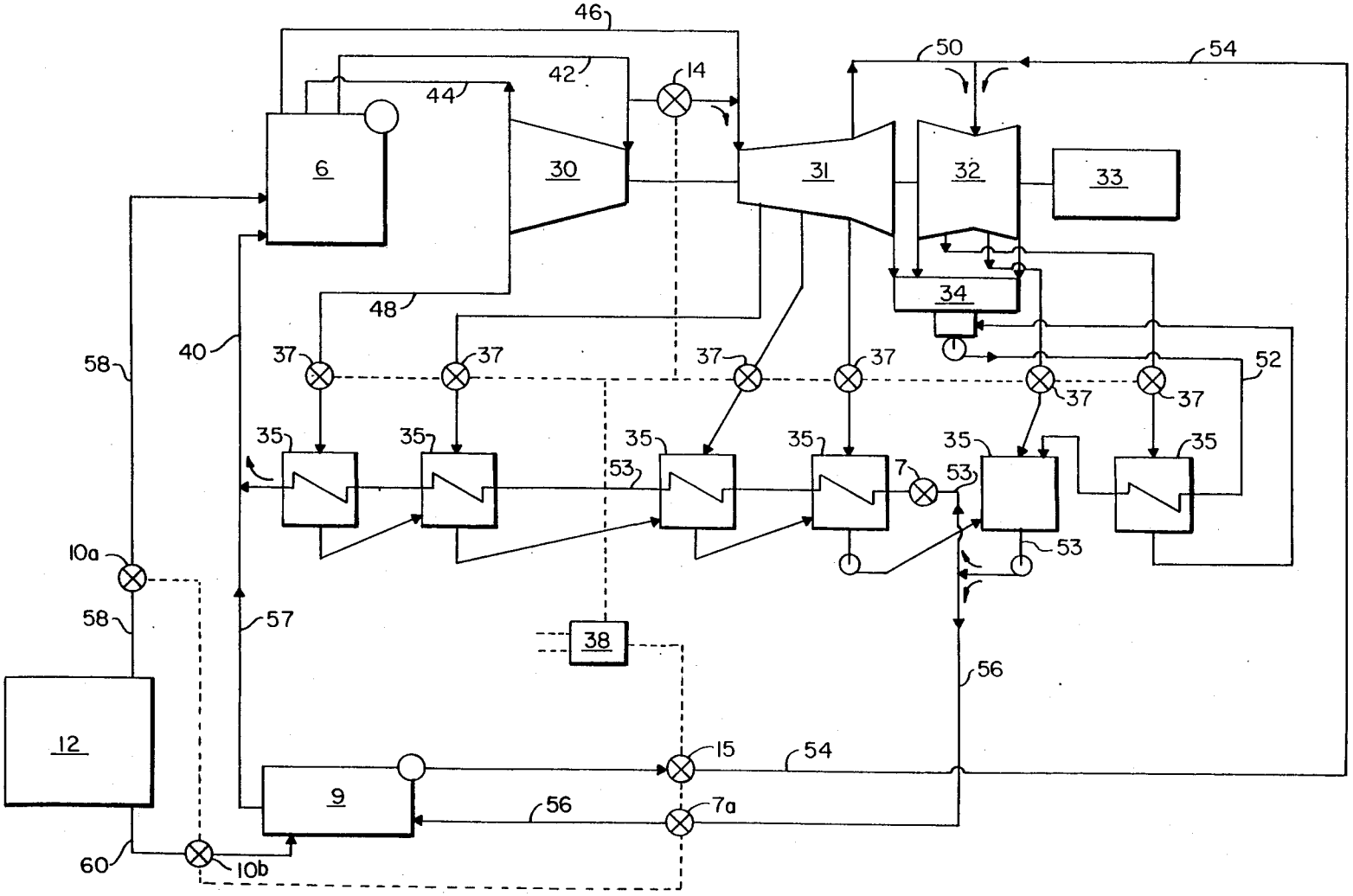

The invention concerns electric power generation, or propulsion, by the combustion of fossil fuels transfering heat to a working fluid which later expands through a turbine, condenses, and is recirculated to the combustors. More specifically, the invention concerns a method which incorporates a fuel cleaning plant producing differing quality fuel streams and two or more combustors, each selected to fire the appropriate fuel stream and provide heat input to the working fluid at a suitable point in the cycle, while minimizing overall emissions from the power plant.

BACKGROUND OF THE INVENTION

In the field of large scale power generation from fossil-fired steam electric power plants, considerable uncertainty exists as to the properties and quality of the fuels that will be fired during the life of the plant. When designing pulverized coal-fired power plants, the boiler size and configuration is often selected on the basis of the lowest grade coal that may be fired by the plant in the future, with the result that an oversized and costlier boiler is specified than will probably be needed.

Also, to reduce emissions from the pulverized coal-fired boiler under the worst possible fuel assumption, the equipment selected for the reduction of particulates, sulfur and nitrous oxides emissions is correspondingly oversized and costlier than will probably be needed.

A variety of Fluidized Bed boilers are currently being developed for firing coal, particularly the lower grades. Such Fluidized Bed boilers are inherently low emitters of particulates, sulfur and nitrous oxides; therefore they require simpler and less costly emissions control systems. However, these Fluidized Bed boiler designs have not been demonstrated for the generation of the high pressure and temperature superheat and reheat steam that is required for efficient electric power generation. Also, questions persist regarding the practicality, economic viability and competitiveness of Fluidized Bed boilers for large power plants vs. Pulverized Coal-fired boilers, even with the added expensive emissions control systems for the latter.

Another alternative (from the Pulverized Coal-fired and the Fluidized Bed boiler choice) is firing higher quality or cleaned coal in a Pulverized Coal-fired boiler. This in most cases will result in higher cost fuel, as well as presenting problems with coal waste, and waste stream disposal from the cleaning plant.

Added impetus to the above fuel and firing equipment selection problems in power generation is provided by situations where existing power plants with boilers designed for a certain type of fuel have to be modified, and the fuel is often altered. Such situations exist when power plants with boilers designed to be fired with oil or natural gas are converted to utilize coal instead, or older coal-fired plants are rehabilitated and their life extended, but changing fuel properties or emissions requirements render the existing Pulverized Coal-fired boilers deficient for the purpose of providing the required steam flow to meet maximum plant output as defined by other plant equipment. A large scale such situation will occur when existing coal-fired power plants in the Mid-West currently firing relatively high sulfur coal will be required to drastically curtail emissions, primarily for the purpose of reducing acid rain deposition in the Northeast United States and the Canadian Maritime Provinces.

DESCRIPTION OF PRIOR ART

Considerable literature exists regarding thermodynamic cycles and equipment arrangements that improve electrical generation efficiency from the combustion of fossil fuels and other sources of heat. The regenerative feedwater heating scheme is such a cycle, with a series of heaters receiving extraction steam from the turbine and preheating feedwater.

The inventor has already been awarded U.S. Pat. Nos. 3,485,048 and 3,826,093 —as well as related foreign patents, regarding cycle modifications and equipment arrangements not directed primarily toward improving cycle efficiency, but for the purpose of increasing power plant output while maintaining reliable operation, in order to meet peaking and unscheduled electric load requirements. The said patents comprise methods for increasing electric output by shutting off turbine steam extraction to the feedwater heaters and increasing steam flow through the turbine, while additional heat input to the cycle is provided by variously increasing heat input to the boiler's economizer; partial main steam by-pass around high pressure turbine sections and partial diversion of saturated (drum) steam around the superheater to the reheater are also means employed for increasing electric power output by the plant. The present invention also utilizes similar steam and feedwater circuitry modifications; however, additional heat input to the cycle is provided in an external combustor and the method is not intented only for generation to meet peaking and uscheduled electrical demand.

SUMMARY OF THE INVENTION

My invention concerns a power plant system incorporating a fuel cleaning plant, two or more combustors, and other power generation equipment arranged so that relatively low grade fuels can be utilized for power generation—while maintaining acceptable levels of emissions from the combustion of fuel, at reduced overall combustion and emission control equipment cost. Lesser quantities of particulates, sulfur and nitrous oxides will be generated because the pulverized coal fired boiler will be firing coal lower in ash and sulfur than if the coal had not been cleaned and at a lower rate than if supplying the total heat input requirements needed for the amount of power generated; the fluidized bed boiler supplying the remainder of the heat input produces considerably lower quantities of the above pollutants. The total emissions will be considerably greater if the uncleaned fuel was to be fired in a pulverized coal-fired boiler utilizing the same level of emissions control technology as the pulverized coal-fired boiler included in our system.

As an example, a simple coal cleaning plant can be used to separate coal into two streams. The relatively clean stream, higher in heating value and lower in ash and sulfur can be fired in a pulverized coal-fired boiler, which can be sized smaller and with a correspondingly smaller emissions control system than if firing the uncleaned coal. The higher in ash and sulfur and lower in heating value waste stream from the cleaning plant, rather than being discarded wasting coal and creating disposal problems, can be fired in a fluidized bed combustor which is suitable for firing low grade fuels while generating lesser amounts of particulates, sulfur and nitrous oxides emissions than a pulverized coal-fired boiler. However, fluidized bed boilers have not been demonstrated as suitable for generating the large quantities of superheated and resuperheated stream required by central station powerplants; therefore, its duty can be limited to preheating feedwater and the generation of relatively small quantities of low pressure steam. Integration of the two combustors' feedwater and steam circuitry into a thermodynamically appropriate arrangement provides for good energy conversion efficiency, without coal waste and with reduced emissions from the power plant. The fuel streams' compositions and rates of flows need not be in constant proportions; they can vary as required by incoming fuel quality, electric plant load, and other factors; the low quality fuel waste stream can be continuous, or intermittent.

For example, when much less than full power plant output is needed, the pulverized coal-fired boiler could be fired with incoming (uncleaned) coal and it can also assume feedwater preheating duties, while meeting emissions limits at the reduced firing rate. With increasing electrical demand, the pulverized coal-fired boiler can be switched to progressively cleaner coal from the cleaning plant, or from storage, and be able to generate superheated and reheated steam at high rates while giving up the feedwater heating function to the fluidized bed boiler. The latter will be receiving progressively lower quality fuel from the cleaning plant and could also generate quantities of low pressure and temperature steam for eduction into the lower pressure turbine stages, further augmenting power plant electric output.

Several other modes of cleaning plant and power plant operation will be feasible. Other combustors than the pulverized coal-fired and fluidized bed types can be used with this arrangement, such as the so-called Low NOx slugging combustor.

Other fuels than coal can be utilized in either of the (two or more) combustors. For example, natural gas or oil can be fired in the larger boiler at periods of particularly high electrical demand to increase output, while the smaller combustor can be continuously or intermittently fired with municipal refuse, or other low grade liquid and solid fuels.

FIG. 1 is a diagramatic illustration of an embodiment of the invention. It shows an integrated coal cleaning and power generation system with a fuel cleaning plant 12, supplying combustor 6 with a high quality fuel stream through a fuel line incorporating fuel control means 10*a*, and a second combustor 9 being supplied by the said fuel cleaning plant with a lower quality fuel stream through a fuel line incorporating control means 10*b*. Also shown in FIG. 1 are a steam turbine with a high pressure section 30, an intermediate and low pressure section 31, low pressure sections 32, electric generator 33, turbine steam extraction valves 37 to feedwater heaters 35, feedwater valves 7, 7*a*, high pressure steam by-pass valve 14, lower pressure eduction steam valve 15 and control device 38 receiving signals regarding electric load demand and status conditions of various system components and parameters and transmitting appropriate control signals to control devices.

Several modes of fuel cleaning plant, combustor and other power generation equipment operation will be possible and will be determined by factors such as electric load demand and fuel quality. For example at low electric loads combustor 9 can be inactive and the fuel stream to combustor 6 can be untreated, with the coal cleaning plant inactive or operating so as to only slightly improve the quality of fuel to combustor 6; feedwater preaheating will be carried out by turbine extraction steam. At higher electrical loads fuel cleaning plant activity increases with combustor 6 receiving increasingly higher grade fuel while combustor 9 consumes the lower grade stream from the fuel cleaning plant and assumes feedwater preheating duties after control device 38 has progressively reduced or has interrupted turbine steam extraction flows to all or several feedwater heaters 35 by the operation of valves 37 and appropriate control of feedwater valves 7, 7*a*. At even higher electric demand, fuel cleaning plant activity intensifies and combustor 6 receives a very high grade fuel stream from the cleaning plant, possibly augmented with high quality fuel from storage, or other sources, while fuel input to combustor 9 also increases; the latter now not only preheats feedwater but also is generating quantities of steam which is being educted into the steam turbine through the operation of valve 15, while additional high pressure steam generated by combustor 6 is also diverted to lower pressure turbine sections (after pressure reduction) through the operation of valve 14.

Feedwater through line 40 enters primary combustor 6 where it is heated and turned to steam which enters high-pressure turbine 30 on line 42. After spinning turbine 30, a portion of the steam is returned through line 44 to primary combustor 6, where it is resuperheated and provided on line 46 to intermediate pressure turbine 31. Some or all of the steam may be passed from turbine 30 through line 48 and one of valves 37, as controlled by control device 38, and into one of conventional feedwater heaters 35.

After the steam passes through intermediate turbine 31, some or all of the steam is conveyed through line 50 to low-pressure turbine 32. The steam exits low-pressure turbine 32, is condensed in condenser 34, and the condensate is conveyed through lines 52 and 53 through feedwater heaters 35. This arrangement is similar to the systems described in U.S. Pat. Nos. 3,485,048 and 3,826,093 by Miliaras.

Secondary combustor 9 is supplied on line 56, as controlled through valve 7*a*, with feedwater diverted from line 53; the feedwater partially or fully bypasses the remaining feedwater heaters 35. Secondary combustor 9 supplements the heating of feedwater, provides additional steam to low-pressure turbine 32, or accomplishes both functions. As desired, steam is provided through line 54 to supplement the steam provided through line 50 which enters low-pressure turbine 32. To supplement the heating of feedwater, valves 37 and 7 are partially or fully closed, valve 7*a* is opened, and feedwater provided through line 56 is heated by secondary combustor 9 and provided through lines 57 and 40 to primary combustor 6.

Control device 38 opens valve 15 when secondary combustor 9 supplements steam to low-pressure turbine 32; control device 38 closes valve 7*a* when secondary combustor 9 is not utilized. Control device 38 also regulates the amount of fuel fed from supplying conduits 58, 60 through valves 10*a*, 10*b* according to the heating requirements or total emission requirements of the power generation system. For example, if additional power generation is desired without significantly increasing total emissions, valve 10*b* is opened further to increase heat generation by combustor 9.

What I claim is:

1. A power generation system comprising:

a primary combustor utilizing a relatively clean, high heat valve fuel to provide a relatively high source of heat;

a fluid in heat exchange with said primary combustor whereby said fluid is thermally energized;

means for expanding said energized fluid to obtain a work output;

means for recirculating said fluid back to said primary combustor to produce a closed system and establish a power generation cycle;

at least one further combustor which utilizes a lesser quality of fuel than said first combustor for producing a lower grade source of heat;

means for furnishing heat from said second combustor to a part of said power generation cycle other than that of said primary combustor;

means for processing a source of fuel whereby a supply of high and low grade fuel is produced;

means for selectively furnishing both said primary and secondary combustors with appropriate fuel from said fuel processing means; and means for selectively operating said primary and secondary combustors in accordance with an operating parameter of said power generation cycle.

2. A power generation system comprising:

a first combustor;

a fluid in heat exchange with said first combustor whereby said fluid is thermally energized;

means for expanding said energized fluid to obtain a work output;

means for recirculating said fluid back to said first combustor to produce a closed system and establish a power generation cycle;

a second combustor utilizing a lesser quality of fuel than said first combustor;

means for furnishing heat from said second combustor to a part of said power generation cycle other than that of said first combustor; and control means for selectively distributing a first grade fuel and a second grade fuel, of lesser quality than said first grade fuel, to said first and second combustors, respectively, and for selectively operating said first and second combustors according to an operating parameter of said power generation cycle.

3. The system of claim 2 in which said second combustor has lower emissive characteristics than said first combustor.

4. The system of claim 3 in which said control means provides increased amounts of said first grade fuel to said first combustor and said second grade fuel to said second combustor when greater power generation is desired.

5. The system of claim 3 in which said operating parameter includes minimizing total emissions from said power generation system.

6. The system of claim 2 further including means for supplying said first and second grade fuels to said control means.

7. The system of claim 6 in which said means for supplying includes means for processing a source of fuel to produce said first and second grade fuels.

8. The system of claim 7 in which said means for processing improves the quality of said first grade fuel when increased output from said first combustor is desired.

9. The system of claim 2 in which said means for furnishing provides heat from said second combustor to said means for recirculating to preheat said fluid before it enters said first combustor.

10. The system of claim 2 in which said means for furnishing provides heat from said second combustor to further energize fluid supplied to said means for expanding.

11. The system of claim 2 in which said second combustor is a fluidized bed boiler.

12. The system of claim 2 in which said first combustor utilizes relatively clean, high heat valve fuel.

13. The system of claim 2 in which said first combustor is a pulverized coal-fired boiler.

14. A power generation system comprising:

a first combustor utilizing a relatively clean, high heat value fuel;

a fluid in heat exchange with said first combustor whereby said fluid is thermally energized;

means for expanding said energized fluid to obtain a work output;

means for recirculating said fluid back to said primary combustor to produce a closed system and establish a power generation cycle;

a second combustor utilizing a lesser quality of fuel than said first combustor and having lower emissive characteristics than said first combustor;

means for furnishing heat from said second combustor to a part of said power generation cycle other than that of said primary combustor; and control means for selectively distributing a first grade fuel and a second grade fuel, of lesser quality than said first grade fuel, to said first and second combustors, respectively, and for selectively operating said first and second combustors according to an operating parameter of said power generation cycle.

15. The system of claim 14 further including means for processing a source of fuel to produce said first and second grade fuels.

* * * * *